United States Patent [19]

Dawson et al.

[11] 3,942,791

[45] Mar. 9, 1976

[54] TWIN PEDAL ENERGIZER

[76] Inventors: John D. Dawson; George Spector, both of 3615 Woolworth Bldg., 233 Broadway, New York, N.Y. 10007

[22] Filed: Aug. 26, 1974

[21] Appl. No.: 500,478

[52] U.S. Cl. ..... 272/83 R; 128/57; 272/57 D

[51] Int. Cl.[2] ..... A63B 23/04

[58] Field of Search..... 272/83 R, 83 A, 82, 57 D, 272/58; 128/57

[56] References Cited

UNITED STATES PATENTS

| | | | |
|---|---|---|---|
| 2,285,958 | 6/1942 | Wheelock | 128/57 |
| 2,374,730 | 5/1945 | Catlin | 128/57 X |
| 2,841,139 | 7/1958 | Tarr | 128/57 X |
| 3,003,764 | 10/1961 | Yovanovitch | 272/83 R X |
| 3,295,847 | 1/1967 | Matt, Sr. | 272/57 D UX |
| 3,497,216 | 2/1970 | Feather | 272/83 R |
| 3,741,540 | 6/1973 | Shimizu | 272/83 R |

FOREIGN PATENTS OR APPLICATIONS

| | | | |
|---|---|---|---|
| 1,143,790 | 2/1969 | United Kingdom | 128/57 |

*Primary Examiner*—Paul E. Shapiro

[57] ABSTRACT

An exercising device for a person's feet while he is seated, thus promoting good health particularly in those people who do not walk enough, such as older or confined persons; the device consisting of a pair of foot pedals that pivot about a hinge below the heel and against the action of a return spring so that when the pedals are pushed downward by feet placed thereupon, the pedals return upward again, including a compressible roller pivotally secured to each pedal whereby downward movement of the pedal causes the roller to move along the pedal over the users foot to provide a massaging action.

2 Claims, 5 Drawing Figures

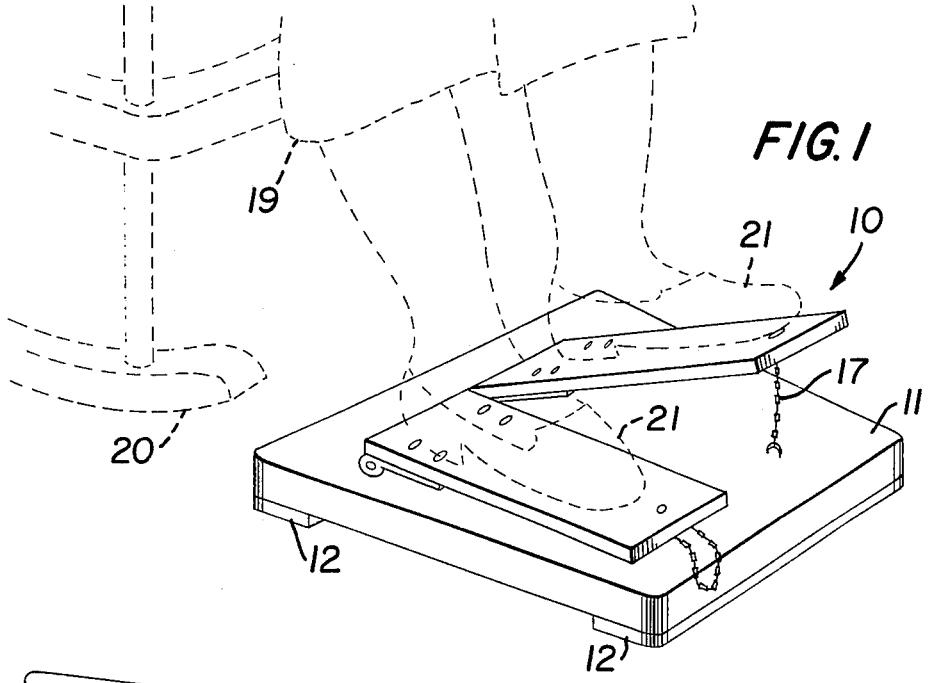
FIG. 1
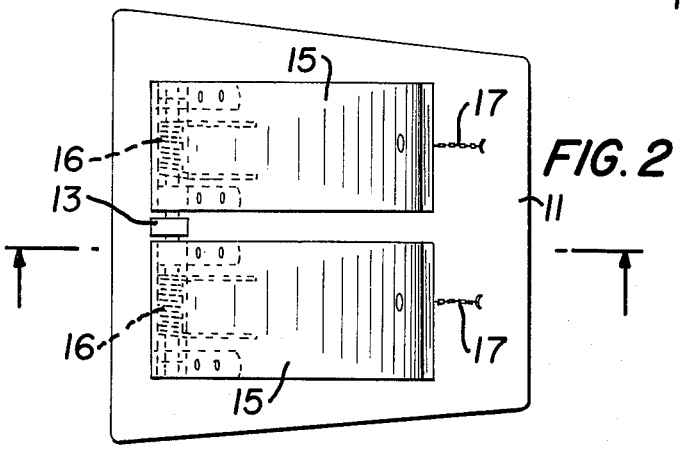
FIG. 2
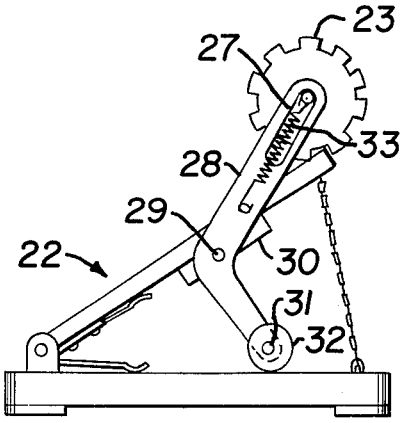
FIG. 4
FIG. 3
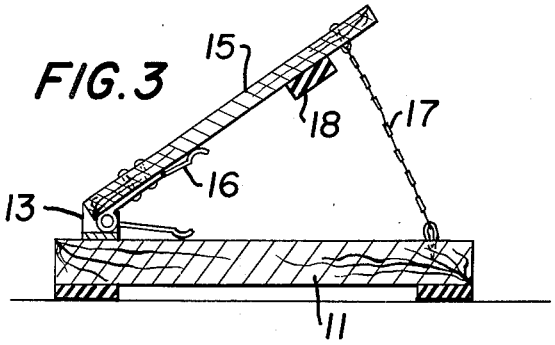
FIG. 5
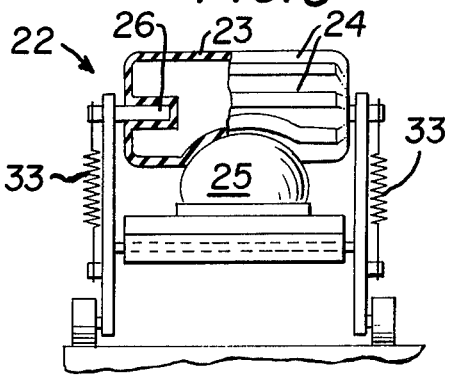

TWIN PEDAL ENERGIZER

This invention relates generally to exercising devices.

It iw well known that walking and movement of the feet muscles are necessary for maintaining good health. A lack of enough exercising of these muscles can result in muscle cramps throughout the legs, hips and other parts of the body. A great many persons unfortunately are not able to normally exercise these muscles, particularly persons who are confined so to sit a great deal so they are more apt to suffer from the lack of their vital muscular movement so to stay in good health. This situation is, of course, objectionable and is, therefore, in want of an improvement.

Accordingly, it is a principle object of the present invention to provide an energizer for exercising the both feet of a person while he is seated in a chair or rocking chair, and which will stimulate the blood circulation, strengthen the foot muscles and aid in preserving a person's general good health.

Another object is to provide a twin pedal energizer which is designed particularly to help older persons who sit a great deal and walk less, and which is also helpful to patients and others who may be confined to a chair so that their muscles need flexing.

Other objects are to provide a twin pedal energizer which is simple in design, inexpensive to manufacturer, rugged in construction, easy to use and efficient in operation.

These and other objects will be readily evident upon a study of the following specification and the accompanying drawing wherein:

FIG. 1 is a perspective view of the invention.

FIG. 2 is a top view thereof.

FIG. 3 is a side cross section on line 3—3 of FIG. 2.

FIG. 4 is a side view of a modified design of the invention in which there is additionally included an air inflated rubber roller that automatically rides up over the upper side of the foot when the pedal is depressed, thus messaging the top of the foot.

FIG. 5 is a front view of a portion thereof, and showing the roller partly in cross section to illustrate how it deforms to fit the foot as it travels thereacross for contacting a broader surface.

Referring now to the drawing in detail, and more particularly to FIGS. 1 to 3 thereof at this time, the reference numeral 10 represents a twin pedal energizer according to the present invention wherein there is a flat base plate 11 mounted upon rubber feet 12 so to prevent skidding upon a floor surface.

Upon the upper side of the plate 11 a bearing bracket 13 is secured, the bracket supporting a long horizontal pin 14 about which a pair of foot pedals 15 are pivotally retained. A pair of coil springs 16 wrapped around the pin 14 serve to normal urge the pedals to be upwardly pivoted by means of one ends of the springs bearing against the undersides of the pedals.

A pair of chains 17 connected at one end to the base plate are connected at their other ends to the outer ends of each pedal 15 and serve to limit the upward pivotal travel thereof.

A rubber block 18 secured under the forward end of each pedal 15 serves to cushion a shock when the pedal is brought down fast against the base.

In operative use, it is now evident that a person 19 sitting in a chair or rocking chair 20 can place one foot 21 on each pedal 15 and push down thereupon independantly or together with the rocking rotion of the rocking chair. As the pedal pivots, the person's foot likewise pivots while applying downward force so that the muscles are exercised and stengthened.

This exercise can be done for specific lenghts of periods, and a specific number of periods each day. Otherwise, it can be done whenever it so pleases a person, so to just relay physically and mentally.

In FIGS. 4 and 5, a modified design of twin pedal energizer 22 includes all the above described structure, and additionally includes a structure that exercises the upper side of the feet at a same time.

This consists of a hollow soft rubber roller 23 having cleats 24 on its outer side so to roll over the upper side of the foot 25 and thus stimulate blood circulation by messaging the same.

The roller pivots about stub shafts 26 supported in slot 27 of a pair of rocker arms 28 that each pivot at their centers about a pin 29 secured in a block 30 fastened on the underside of the pedals 15. A lower end of each arm 28 supports a pin 31 about which a wheel on roller 32 is rotatable.

In use, as a person pushes the pedal 15 with a foot, the roller 32 travels frontward on the top surface of the base 11 thus causing the arm to pivot about pin 29 so to cause the roller 23 to roll upward over the top of a person's foot. A tension spring attached to each shaft 26 pulls the roller 23 against the foot while at a same time allowing the roller to move away when it means with a thicker portion of the foot. The structure comprising the arms 28 and springs 33 can be enclosed so that a person does not get his foot caught in it, and also make the device more attractive.

Thus a useful energizer is provided.

While various changes may be made in the detail construction, it is understood that such changes will be within the spirit and scope of the present invention as is defined by the appended claims.

What is claimed is:

1. A foot pedal exerciser comprising a base plate with a bracket secured thereto having a horizontal hinge pin mounted therethrough spaced from and adjacently parallel to said plate, said braket being secured to the midpoint of the pin, including a pair of pedals pivotally mounted on the pin, symmetrically on both sides of the braket in further combination with a pair of springs coiled about the pin having terminal portions contacting the pedals and the plate biasing the pedals to open positions whereby the free ends of said pedals are at a maximum distance from the plates, including tension members connecting the pedals and the plates restricting movement of said free ends to said maximum distance, said members offering no resistance to closing movement of said pedal free ends, in further combination with a lever pivotally secured to each pedal, including a compressible roller rotatably secured to each lever above each pedal, said roller having an axis parallel to the axis of rotation of said pedal about said hinge pin, each lever being secured to each pedal between the roller and hinge pin and including a lower end movably engaging said base below said pedal whereby downward movement of the pedal causes the lever to pivot and move the roller along the pedal.

2. A device as in claim 1 wherein said roller is movable longitudinally relative to the lever including resilient means mounted on said lever biasing the roller towards the pedal.

* * * * *